US007735361B2

(12) United States Patent
Hoss

(10) Patent No.: US 7,735,361 B2
(45) Date of Patent: Jun. 15, 2010

(54) TESTING DEVICE FOR A CAM-DRIVEN FUEL INJECTION SYSTEM, IN PARTICULAR A PUMP/NOZZLE OR PUMP/LINE/NOZZLE INJECTION SYSTEM

(75) Inventor: Reinhard Hoss, Plochingen (DE)

(73) Assignee: Robert Bosch GmbH, Stuttgart (DE)

( * ) Notice: Subject to any disclaimer, the term of this patent is extended or adjusted under 35 U.S.C. 154(b) by 183 days.

(21) Appl. No.: 12/096,521

(22) PCT Filed: Nov. 2, 2006

(86) PCT No.: PCT/EP2006/068022

§ 371 (c)(1),
(2), (4) Date: Jun. 6, 2008

(87) PCT Pub. No.: WO2007/073967

PCT Pub. Date: Jul. 5, 2007

(65) Prior Publication Data

US 2008/0282785 A1 Nov. 20, 2008

(30) Foreign Application Priority Data

Dec. 27, 2005 (DE) ..... 10 2005 062 453

(51) Int. Cl.
*F02M 65/00* (2006.01)

(52) U.S. Cl. ..... 73/114.45

(58) Field of Classification Search ..... 73/49.7, 73/114.45, 114.46

See application file for complete search history.

(56) References Cited

U.S. PATENT DOCUMENTS

| | | | | |
|---|---|---|---|---|
| 2,517,766 | A * | 8/1950 | Cole | 73/49.7 |
| 2,744,407 | A * | 5/1956 | Kruger | 73/49.7 |
| 2,857,759 | A * | 10/1958 | Kiene | 73/114.45 |
| 3,117,444 | A * | 1/1964 | Taylor | 73/114.45 |
| 3,282,092 | A * | 11/1966 | Lajza | 73/114.45 |
| 3,408,862 | A | 11/1968 | Hainz | |
| 4,061,027 | A * | 12/1977 | Emerson | 73/114.45 |
| 4,289,105 | A * | 9/1981 | Noraberg | 123/500 |
| 4,561,297 | A * | 12/1985 | Holland | 73/114.45 |
| 5,806,487 | A * | 9/1998 | Dolenc | 123/357 |
| 6,823,712 | B2 * | 11/2004 | Bodenmueller et al. | 73/1.71 |
| 7,089,789 | B2 * | 8/2006 | Klopfer et al. | 73/114.45 |
| 7,370,520 | B2 * | 5/2008 | Kortsen | 73/114.45 |
| 2008/0195295 | A1 * | 8/2008 | Kaneko | 701/103 |

FOREIGN PATENT DOCUMENTS

| | | |
|---|---|---|
| DE | 101 46 772 A1 | 4/2003 |
| GB | 1 236 238 | 6/1971 |

* cited by examiner

*Primary Examiner*—Lisa M Caputo
*Assistant Examiner*—Freddie Kirkland, III
(74) *Attorney, Agent, or Firm*—Ronald E. Greigg

(57) ABSTRACT

A test apparatus serves to test cam-driven fuel injection systems. The apparatus includes a camshaft which can act on a piston of the fuel injection system at least indirectly via a lever. It is proposed that the lever have a multiplicity of fastening positions for an actuating element which can act on the piston and that the fastening positions be disposed at different distances from a pivot axis of the lever.

20 Claims, 2 Drawing Sheets

TESTING DEVICE FOR A CAM-DRIVEN FUEL INJECTION SYSTEM, IN PARTICULAR A PUMP/NOZZLE OR PUMP/LINE/NOZZLE INJECTION SYSTEM

CROSS-REFERENCE TO RELATED APPLICATION

This application is a 35 USC 371 application of PCT/EP 2006/068022 filed on Nov. 2, 2006.

BACKGROUND OF THE INVENTION

1. Field of the Invention

The invention relates to a testing device for a cam-driven fuel injection system, in particular a unit injector injection system or unit pump injection system.

2. Description of the Prior Art

In modern diesel engines, a fuel injection system injects the fuel at high pressure directly into the combustion chamber. There are various types of fuel injection systems used for this, for example unit injector injection systems or unit pump injection systems. Both fuel injection systems are actuated directly on the engine itself by means of a cam shaft. Via a lever, a cam on the cam shaft produces a stroke of a pump piston of the fuel injection system. This produces a very high pressure at a nozzle of the fuel injection system, which pushes a valve needle into an open position and as a result, fuel is injected into a combustion chamber of the engine. The injection quantity is adjusted by means of a solenoid valve, which controls the buildup of pressure in the fuel injection system.

The injection pressure and the injection quantity depend, among other things, on the shape of the cam and its stroke. Different fuel injection systems have different strokes and cam shapes. In some cases as well, identical fuel injection systems are actuated with an identical stroke in different types of engines with different cams.

Testing devices used for testing purposes and for the quality control of the above-described cam-driven fuel injection systems are known from the market. One such testing device has a cam-driven fuel injection system built into it. The piston of the fuel injection system is acted on by means of a cam shaft and a lever so as to simulate an operating situation. In the known testing device, the same cam is used for various types of fuel injection systems and all fuel injection systems are operated with the same stroke. In order to avoid damage, this stroke is relatively small. There is also a known testing device in which the cams of the cam shaft are replaceable. It is thus possible to associate each fuel injection system with a specific cam.

OBJECTS AND ADVANTAGES OF THE INVENTION

The object of the present invention is to disclose a testing device of the type mentioned at the beginning that is able to carry out testing on the various fuel injection systems in an inexpensive and technically meaningful fashion.

This object is attained by a testing device with the defining characteristics of the invention. Important defining characteristics of the invention are contained in the description and the drawings. It should be noted at this point that these defining characteristics can be essential to the invention in widely varying combinations, without having to be explicitly referred to herein.

With the testing device according to the invention, various strokes of the piston in a fuel injection system can be implemented with one and the same cam. As a result the fuel injection systems can be tested not only in the lower pressure range, but also in the upper pressure range, which improves the significance of the test carried out. A complicated changing of the cams is not required, resulting in low operating and manufacturing costs of the testing device according to the invention.

This is made possible by the fact that the lever is embodied so that it can be operated with various lever arms and therefore with various strokes. The various lever arms can be represented by discrete fastening positions or for example by means of a linear adjustability of the actuating element on the lever. In this case, the lever is preferably embodied in the form of a pivoting lever or rocking lever.

An advantageous modification of the testing device according to the invention is distinguished by the fact that the lever includes a replaceable intermediate element on which the different fastening positions for the actuating element are provided. In this way, the application range of the testing device can be expanded even further and the manufacturing and operating costs of the testing device are reduced since the lever can be standardized and instead the intermediate plate is provided with the corresponding fastening positions. For example, a model-specific intermediate plate with different fastening positions can be provided for each of the various models of fuel injection system. The intermediate element is significantly less expensive to manufacture than the lever.

A particularly preferable embodiment is distinguished by the fact that the fastening positions are composed of threaded bores into which the fastening element is screwed. This implementation is particularly inexpensive and simple to use.

Another, particularly advantageous embodiment of the testing device according to the invention is distinguished by the fact that it includes a fastening device with a plurality of fastening positions for the fuel injection system; each fastening position corresponds to a particular spacing of a longitudinal axis of the piston of the fuel injection system from the pivoting axis of the lever. This reduces the transverse forces that the actuating element introduces into the piston of a fuel injection system and provides a good simulation of the actual operating conditions of the fuel injection system to be tested. Here, too, a plurality of discrete fastening positions can be provided or a device can be used that is linearly adjustable and consequently makes it possible to achieve a multitude of intermediate positions.

Here, too, adapter elements can be provided that permit various fuel injection apparatuses to be attached to the fastening positions of the fastening device. This extends the application range of the testing device according to the invention to very different types of fuel injection apparatuses while simultaneously keeping down costs since the actual fastening device can remain unchanged for all fuel injection apparatuses.

It is particularly advantageous if the fastening positions are individualized so that each type of vehicle system is unmistakably associated with a particular fastening position. This assures that the respective test specimen is associated with the correct stroke. This in turn simplifies the use of the testing device according to the invention and reduces the frequency of false test results.

Another particularly advantageous embodiment of the testing device according to the invention is distinguished by the fact that it includes a sensor that at least indirectly detects a reaction force that occurs during an actuation of the fuel injection system. This permits it to also detect defects or deficiencies, for example in the leak-tightness of the fuel injection system tested, which cannot be detected solely by measuring the injection quantity or by means of a visual inspection.

In this case, the sensor can be situated on the lever so that it detects the force there. But it is even more preferable if the fastening device is supported in pivoting fashion and is supported by means of a pendulum support and if the sensor detects a force acting on the pendulum support or on a bearing block of the pendulum support. The latter embodiment minimizes transverse force influences on the measurement result and thereby increases the significance of the reaction force measurement.

According to another embodiment, the cam shaft has a plurality of different cams situated next to one another and the lever, together with the fastening device for the fuel injection apparatus, can be moved into various operating positions in the axial direction of the cam shaft; in each operating position, the lever cooperates with a different cam. As a result, it is also possible to implement various pressure curves in the fuel injection systems tested without requiring the expense of a cam change. This reduces the changeover time when using the testing device according to the invention, thus also reducing operating costs. Naturally, in practice, the aim is to use the lowest possible number of cams. Since the cam shapes have only slight differences, an identical stroke achieves approximately the same levels of pressure. However, it is useful in each instance to first detect reference values by means of corresponding reference measurements.

BRIEF DESCRIPTION OF THE DRAWINGS

A particularly preferred exemplary embodiment of the present invention will be explained in greater detail below in conjunction with the accompanying drawings, in which.

DESCRIPTION OF THE PREFERRED EMBODIMENTS

Figure 1:
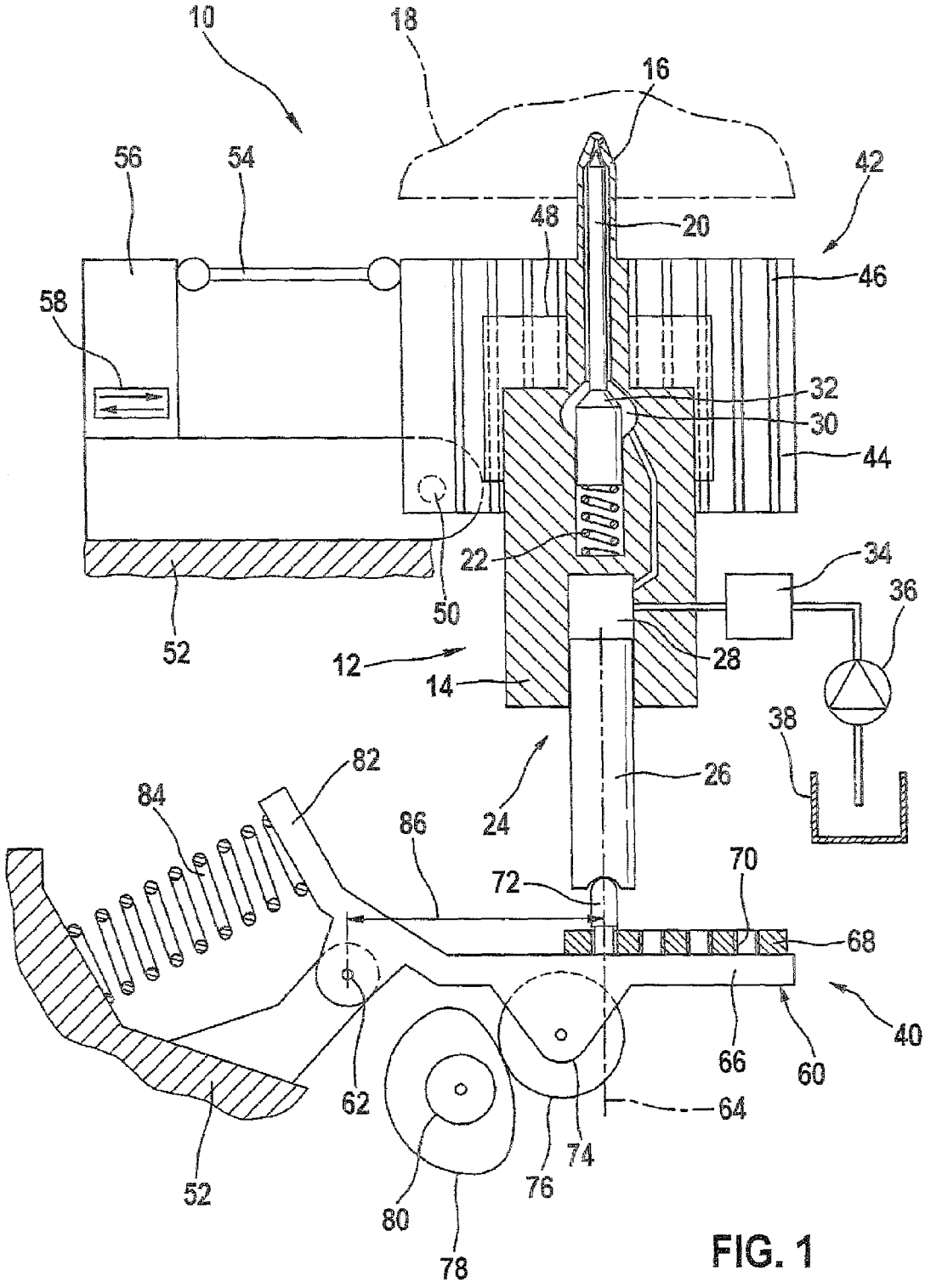
FIG. 1 is a schematic, partially sectional depiction of a testing device for a cam-driven fuel injection system.
Figure 2:
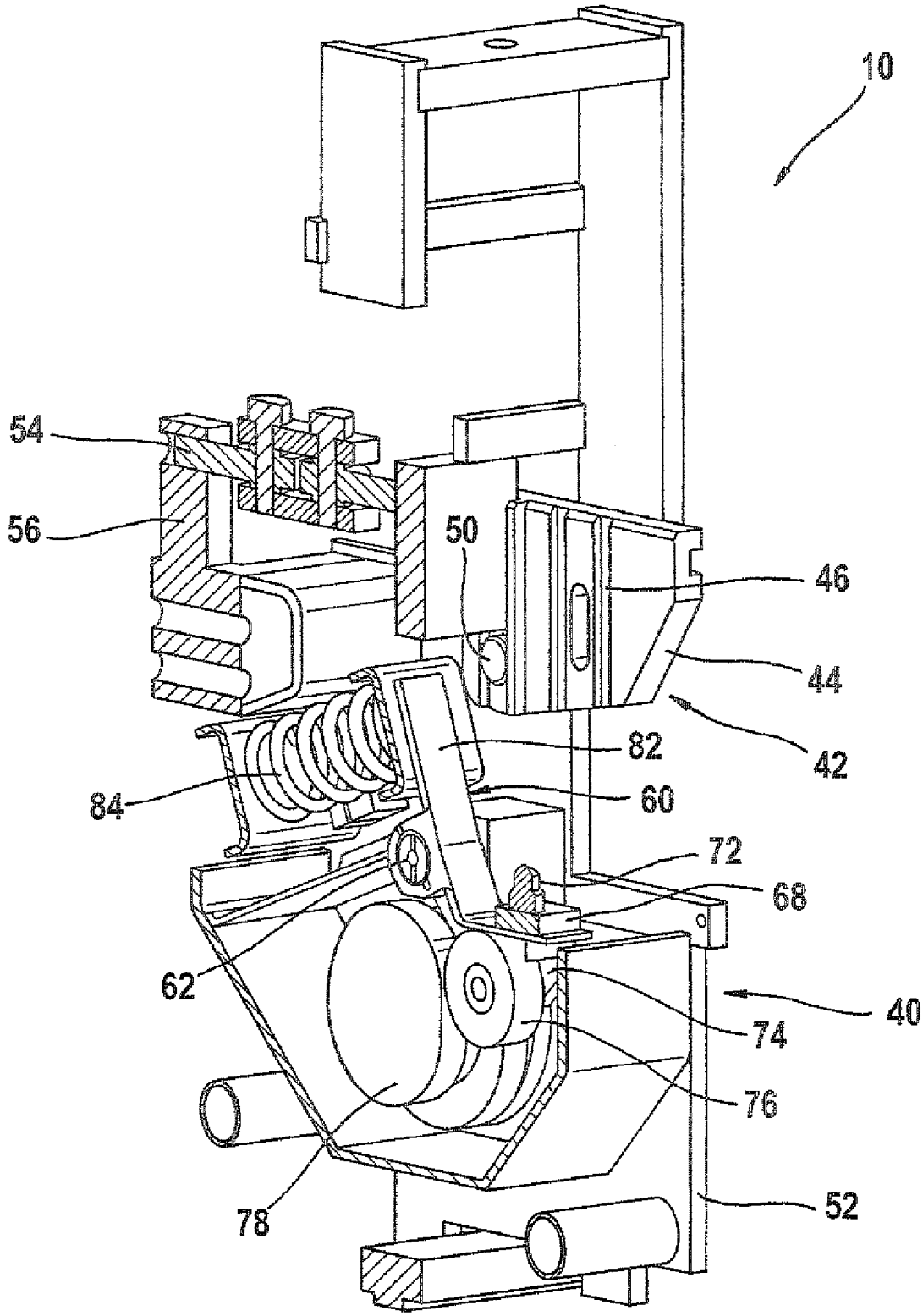
FIG. 2 is a perspective, likewise partially sectional, more detailed depiction of the testing device from FIG. 1.

In FIGS. 1 and 2, a testing device is labeled as a whole with the reference numeral 10. It is used to test a cam-driven fuel injection system, in the current example a unit injector injection system 12, which is only shown in FIG. 1. First, a description will be given of its design and function.

The unit injector injection system 12 includes a housing 14 with a nozzle tip 16 that protrudes into an injection chamber 18 of the testing device 10. The housing 14 contains a nozzle needle 20 that is accommodated in sliding fashion and acted on by a spring 22 that moves it into a closed position.

A pump of the unit injector injection system 12 is labeled 24 and includes a piston 26 that delimits a delivery chamber 28. This delivery chamber communicates with a pressure chamber 30, which is delimited by a pressure surface 32 that is embodied on the nozzle needle 20 and acts in its opening direction. The delivery chamber 28 can also be connected by means of a solenoid control valve 34 and a prefeed pump 36 to a fluid reservoir 38, which in the present instance, stores a testing fluid.

During an intake stroke of the piston 26 when the control valve 34 is open, testing fluid is drawn from the fluid reservoir 38 into the delivery chamber 28. When the control valve 34 is closed during a delivery stroke of the piston 26, the testing fluid enclosed in the delivery chamber 28 is compressed, which results in a corresponding pressure increase in the pressure chamber 30. When the hydraulic force acting on the pressure surface 32 exceeds the force of the spring 22, the nozzle needle 20 opens and testing fluid is injected from the nozzle tip 16 into the injection chamber 18, where it is collected and relayed elsewhere.

For the testing of the unit injector injection system 12, the testing device 10 has two essential subordinate devices: an actuating device 40 and a fastening device 42. First, with regard to the latter:

The fastening device 42 has a guide plate 44 equipped with a number of parallel guide grooves 46, only one of which, for the sake of clarity, is provided with a reference numeral. These guide grooves 46 define different fastening positions for an adapter element embodied in the form of an adapter plate 48. This adapter plate 48 in turn is fastened in a way that is not shown in detail here to the housing 14 of the unit injector injection system 12.

The guide plate 44 is attached at 50 in an hinging fashion to a stationary base 52 of the testing device 10. In order to prevent the guide plate 44 from tilting during operation, at its end oriented away from the hinge 50, it is supported by a pendulum support 54 on a bearing block 56 that is likewise attached to the stationary base 52. Mounted on the bearing block 56 is a sensor embodied in the form of a strain gauge 58, which detects a transverse force acting on the bearing block 56 by means of the pendulum support 54.

The actuating device 40 is constructed as follows. A cam follower 60 is also supported in pivoting fashion at 62 on the stationary base 52. The hinge joint 62 here is spaced laterally apart from a longitudinal axis 64 of the piston 26 of the unit injector injection system 12. One arm 66 of the cam follower 60 extends toward the piston 26. It has an intermediate plate 68 fastened to it that constitutes an intermediate element and contains a plurality of threaded bores 70 (once again for the sake of clarity only one of these is provided with a reference numeral). These threaded bores constitute fastening positions for an actuating element 72 provided with a ball-shaped head. As is clear from FIG. 1, the threaded bores 70 are spaced different distances apart from the pivot axis of the cam follower 60 defined by the hinge 62. The ball-shaped head of the actuating element 22 cooperates with a complementary recess (unnumbered) in the piston 26 of the unit injector injection system 12.

On its side oriented away from the piston 26, the arm 66 is provided with a roller support 74 equipped with a roller 76. This in turn cooperates with a cam 78 of a cam shaft 80. The camshaft is driven by a drive motor not shown here, for example an electric motor. A second arm 82 of the cam follower 60 is acted on by a compression spring 84, which is clamped between the arm 82 and the stationary base 52. In this way, the roller 76 is continuously pressed against the cam 78.

The testing device 10 functions as follows: when the cam shaft 80 rotates, the cam follower 60 is pivoted around its pivot axis 62. Because of the lever arm between the actuating element 72 and the pivot axis defined by the hinge 62 (this lever arm is labeled 86 in FIG. 1), a particular stroke results for each threaded bore 70. This stroke is at a minimum when the actuating element 72 is screwed into the threaded bore 70 in which it is situated in FIG. 1. This produces a corresponding, comparatively small stroke of the piston 26. The reaction force that is introduced into the guide plate 44 via the housing 14 and the adapter plate 48 by means of the pressure increase in the delivery chamber 28 is transmitted via the pendulum support 54 into the bearing block 56 and is detected there by the strain gauge 58.

If the same unit injector injection system 12 is to be tested with a larger stroke, the adapter plate 48 is simply fastened into other guide grooves 46 of the guide plate 44 and the actuating element 72 is screwed into another one of the threaded bores 70. If another unit injector injection system 12 is tested, then another adapter plate 48 is used. It is possible, but not shown, for the guide grooves to be individualized so that each type of fuel injection system is unmistakably associated with a particular fastening position and therefore a particular stroke. In an exemplary embodiment that is likewise not shown, it is also possible for the fastening device, together with the actuating device (without a cam shaft), to be shifted in the longitudinal direction of the cam shaft. The corresponding cam shaft then has a plurality of different cams situated next to one another so that the roller cooperates with a different cam depending on the position of the actuating device.

The foregoing relates to the preferred exemplary embodiment of the invention, it being understood that other variants and embodiments thereof are possible within the spirit and scope of the invention, the latter being defined by the appended claims.

The invention claimed is:

1. A testing device for a cam-driven fuel injection system, in particular a unit injector injection system or unit pump injection system, the testing device comprising:

a camshaft;

a lever being movable by rotation of the camshaft, the lever acting at least indirectly on a piston of the fuel injection system during testing of the fuel injection system;

an actuating element disposed on the lever, the actuating element acting on the piston during testing of the fuel injection system; and a plurality of actuating element fastening positions disposed on the lever for fastening the actuating element thereto, wherein the fastening positions are spaced different distances apart from a pivot axis of the lever.

2. The testing device as recited in claim 1, wherein the lever includes a replaceable intermediate element on which the various fastening positions for the actuating element are provided.

3. The testing device as recited in claim 2, wherein the fastening positions for the actuating element are constituted by threaded bores into which it is possible to screw the actuating element.

4. The testing device as recited in claim 3, further comprising a fastening device equipped with a plurality of fastening positions for the fuel injection system to be fastened at, wherein each fastening position of the fastening device corresponds to a particular spacing of a longitudinal axis of the piston of the fuel injection system from the pivot axis of the lever.

5. The testing device as recited in claim 2, further comprising a fastening device equipped with a plurality of fastening positions for the fuel injection system to be fastened at, wherein each fastening position of the fastening device corresponds to a particular spacing of a longitudinal axis of the piston of the fuel injection system from the pivot axis of the lever.

6. The testing device as recited in claim 5, further comprising a plurality of adapter elements that permit various fuel injection apparatuses to be attached to the fastening positions of the fastening device.

7. The testing device as recited in claim 5, wherein the fastening positions of the fastening device are individualized so that each type of fuel injection system is unmistakably associated with a particular fastening position of the fastening device.

8. The testing device as recited in claim 1, wherein the fastening positions for the actuating element are constituted by threaded bores into which it is possible to screw the actuating element.

9. The testing device as recited in claim 6, further comprising a fastening device equipped with a plurality of fastening positions for the fuel injection system to be fastened at, wherein each fastening position of the fastening device corresponds to a particular spacing of a longitudinal axis of the piston of the fuel injection system from the pivot axis of the lever.

10. The testing device as recited in claim 9, further comprising a plurality of adapter elements that permit various fuel injection apparatuses to be attached to the fastening positions of the fastening device.

11. The testing device as recited in claim 9, wherein the fastening positions of the fastening device are individualized so that each type of fuel injection system is unmistakably associated with a particular fastening position of the fastening device.

12. The testing device as recited in claim 1, further comprising a fastening device equipped with a plurality of fastening positions for the fuel injection system to be fastened to, wherein each fastening position of the fastening device corresponds to a particular spacing of a longitudinal axis of the piston of the fuel injection system from the pivot axis of the lever.

13. The testing device as recited in claim 12, further comprising a plurality of adapter elements that permit various fuel injection apparatuses to be attached to the fastening positions of the fastening device.

14. The testing device as recited in claim 13, wherein the fastening positions of the fastening device are individualized so that each type of fuel injection system is unmistakably associated with a particular fastening position of the fastening device.

15. The testing device as recited in claim 12, wherein the fastening positions of the fastening device are individualized so that each type of fuel injection system is unmistakably associated with a particular fastening position of the fastening device.

16. The testing device as recited in claim 15, wherein the camshaft has a plurality of different cams situated next to one another; the lever, together with the fastening device for the fuel injection apparatus, has the capacity to be moved into various operating positions in an axial direction of the cam shaft; and the lever cooperates with a different cam in each operating position.

17. The testing device as recited in claim 12, wherein the camshaft has a plurality of different cams situated next to one another; the lever, together with the fastening device for the fuel injection apparatus, has the capacity to be moved into various operating positions in an axial direction of the cam shaft; and the lever cooperates with a different cam in each operating position.

18. The testing device as recited in claim 1, further comprising a sensor that at least indirectly detects a reaction force occurring during an actuation of the fuel injection system.

19. The testing device as recited in claim 18, wherein the sensor detects a force acting on the lever.

20. The testing device as recited in claim 18, wherein the fastening device is supported in pivoting fashion and is also supported by means of a pendulum support, the sensor senses a force acting on the pendulum support and/or on a bearing block of the pendulum support.

* * * * *